US006836221B1

(12) United States Patent
Boddie et al.

(10) Patent No.: US 6,836,221 B1
(45) Date of Patent: Dec. 28, 2004

(54) RAILROAD ADVANCE WARNING SYSTEM

(76) Inventors: Mathews E. Boddie, 5590 Bordeaux Cir., Germantown, TN (US) 38125; Donelle Sanders, 425 Hampstead South, Antioch, TN (US) 38013

( * ) Notice: Subject to any disclaimer, the term of this patent is extended or adjusted under 35 U.S.C. 154(b) by 0 days.

(21) Appl. No.: 10/241,672

(22) Filed: Sep. 11, 2002

Related U.S. Application Data

(60) Provisional application No. 60/322,082, filed on Sep. 11, 2001.

(51) Int. Cl.[7] ..... G08B 1/00
(52) U.S. Cl. ..... 340/901; 246/125
(58) Field of Search ..... 340/901, 902, 340/903, 933; 246/293, 294, 122 R

(56) References Cited

U.S. PATENT DOCUMENTS 4,931,793 A * 6/1990 Fuhrmann et al. ..... 340/903
4,952,931 A * 8/1990 Serageldin et al. ..... 340/902
5,554,982 A * 9/1996 Shirkey et al. ..... 340/903
5,620,155 A * 4/1997 Michalek ..... 246/121
5,729,213 A * 3/1998 Ferrari et al. ..... 340/901
5,890,682 A * 4/1999 Welk ..... 246/125

* cited by examiner

*Primary Examiner*—Jeffery Hofsass
(74) *Attorney, Agent, or Firm*—Wyatt, Tarrant & Combs, L.L.C.

(57) ABSTRACT

A vehicle contained warning system and method for warning the occupants of a motor vehicle approaching a railway grade crossing at which there is installed a railway grade crossing warning system including such as warning lights and a crossing gate wherein a radio frequency transmitter radiates selected signals responsive to information stored in the crossing analyzer of the railway grade crossing warning system. Upon approach of a train, the grade crossing warning system begins transmitting an encoded signal including such as information on the approach of the train and what of any of the functional aspects of the warning system may be non operational such as the warning lights, and the crossing gate. The receiver in the vehicle within the range of the transmitter decodes the received signal and activates the contained alarms to alert the occupants (particularly the driver) of the vehicle of the approaching train and the condition of the warning system.

19 Claims, 5 Drawing Sheets

RAILROAD ADVANCE WARNING SYSTEM

CROSS-REFERENCE TO RELATED APPLICATIONS

This application claims benefit of U.S. Provisional Application Ser. No. 60/322,082, filed Sep. 11, 2001.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

This invention relates to a system for providing an advanced warning to motor vehicles of the presence or approach of railroad trains and emergency vehicles.

2. General Background of the Invention

The more immediate application of the present invention is to prevent vehicular accidents with trains at railroad crossings. Improvements in newer models of automobiles have sound-proofed interior compartments which all but eliminated outside noise making interior of the vehicles soundproof and operators are isolated from outside disturbances, such as the clang of a bell at a railroad grade crossing. Further, with the improvement of sound systems in automobiles and the addition of such as cellular telephones and VCRs for viewing by children, the driver's attention is easily obscured and/or distracted from activity in the roadway.

A number of inventions have been developed which are directed to the problems stated above, however none have exhibited sufficient effectiveness, capacity or flexibility to become a significant commercial factor in the market. Systems developed to date fall roughly into two categories: 1) those wherein a radio frequency transmitter is located in the cab of the engine or emergency vehicle and transmits on a designated frequency to a receiver in the vehicle such various information as speed and proximity; and 2) GPS systems wherein information on the locomotive or emergency vehicle is transmitted to the satelite and relayed to a receiver in the automobile.

Examples of the state of the art systems are found in the following patents:

U.S. Pat. No. 1,978,286 to Sommer where the audio receiver equipment located on the train to detect, as by a microphone, ambient audio information such as whistles, warning bells and train sounds such as the general rumble of the train wherein such audio sounds are transmitted to a receiver on the automobile, which broadcasts such sounds in the passenger compartment when the vehicle receiver is within range of the transmitter.

U.S. Pat. No. 3,233,217 to Bost illustrates a system wherein emergency signals such as sirens, bells and whistles are received by microphone in a transmitter located in a train or emergency vehicle and coded according to which type of signal is received and then transmitted at a limited range for receipt by a receiver equipped automobile, which signals within the automobile which of the various alarm signals has been received. In the preferred embodiment a visual indicator is placed on the dashboard or other prominent place for observation by the driver.

U.S. Pat. No. 3,532,986 to Belushia, et al, illustrates a system similar to the above however including the capacity for the automobile to transmit an alarm signal back to the approaching emergency vehicle or train alerting the driver or engineer to traffic in the area.

U.S. Pat. No. 3,735,342 to Helliker, et al, illustrates a transmitter-receiver system which is sensitive to the particular frequencies of sirens (600 Hz, 900 Hz and 1200 Hz) to transmit an alarm to an in-range automobile of the approach of an emergency vehicle.

U.S. Pat. No. 3,760,349 to Keister, et al, discloses an emergency warning system which operates on 500 Hz and 1000 Hz frequencies to detect sirens and transmits an alarm to a receiver in range when the frequencies are detected.

U.S. Pat. No. 4,942,395 to Ferrari, et al, illustrates a system in which a transmitter located in a locomotive transmits a distance limited, coded signal to a receiver mounted a railroad grade crossing, which in turn transmits a shortwave radio signal to a receiver-equipped automobile. Information is transmitted from the locomotive so long as the locomotive is in motion.

U.S. Pat. No. 5,235,329 to Jackson discloses a transmitter-receiver combination wherein the transmitter operates in the citizens band frequency such that a siren detected by the transmitter unit initiates an alarm transmitted on the citizens band frequency for receivers within the limited range of the transmitter.

U.S. Pat. No. 5,729,213 to Ferrari, et al, illustrates a radio-transmitter combination, operation of which is initiated and terminated by the action of an in-track pressure or magnetic sensor which determines the approach and the departure of a train to and from a railway grade crossing. The actual transmitter and receiver information may be broadcast from a battery or hardwired transmitter placed on the crossing indicator standard for proximity related transmission and reception from approaching vehicles and trains.

U.S. Pat. No. 6,025,789 to Lane, et al, discloses a radio transmitter-receiver combination which operates in conjunction with the FSK system currently employed in trains as "head of train" and "tail of train" devices. Such systems typically code a variety of train related information such as brake pressure and speed of the train. The illustrated system utilizes the FSK train specific information to confirm that the transmitted information is from the head end of the train and that it is on the train specific frequency, thereby eliminating the possibility of false signals. The system is also equipped with a whistle detector to provide an additional in-range alarm signal on the event of the blowing of the whistle.

The second category of train or emergency vehicle warning systems operate in conjunction with ground position system receivers. U.S. Pat. No. 5,554,982 to Shirkey, et al, discloses a GPS based system in which a locomotive based or track position based system transmits train speed and position information to the GPS system, which receives the information and calculates emergency zones in relation to railroad grade crossings. A companion vehicle based receiver receives the GPS train information and using the vehicle speed and position information, calculates whether the vehicle will enter the emergency zone, and if so, emits an alarm.

U.S. Pat. No. 5,620,155 to Michaelek illustrates a GPS based system centralized in a locomotive which is capable of identifying railroad grade crossings being approached by the locomotive for the purpose of the locomotive based system to actuate the grade crossing alarm as well as perform maintenance checks on the various components such as status of lights, arm actuation, and sound alarms. The system also includes a related receiver in a vehicle such that those vehicles in proximity to the identified grade crossing also received a warning signal.

U.S. Pat. Nos. 5,699,986 and 5,890,682 to Welk illustrate a GPS based collision avoidance system which is centralized to specific grade crossings, such that the unit receives and process such as speed and position information of comparable transmitter-receiver systems on trains and vehicles to generate a variety of alarm level warnings, depending upon the proximity of train or vehicle, including alerting the vehicle of the proximity of a grade crossing and the possibility of a collision.

The present invention bears resemblance to the above described prior art systems only in the aspect that information is received by an approaching automobile of the concurrent approach of a train to a grade crossing or an emergency vehicle in the immediate area. The apparatus and methodology of the inventive system provide a significantly improved overall reliability of reporting as well as utilizing existing components already incorporated into railway grade crossing signals and gates. Accordingly, the present invention provides a railway warning system which may be standardized to equipment already mandated by various state and federal regulatory codes.

BRIEF SUMMARY OF THE INVENTION

It is an object of the present invention to provide method and apparatus for the transmission of a warning of a vehicle approaching a railroad grade crossing to alert its occupants, including particularly the driver, of any approach of a train to that grade crossing. The present invention operates integrally with a railroad grade crossing warning system, utilizing certain of the event information collected and recorded within the crossing analyzer of the grade crossing warning system to supply such information to the vehicle, which may then trigger various alarms and information sources in the receiver equipment within the vehicle. The transmitter, operating in response to preselected information supplied to the crossing analyzer, preferably encodes such information as the approach of a train to the specific grade crossing and any nonoperational features of the grade crossing warning system such as total nonoperational character of the system or specific nonoperational features such as the warning lights, crossing gate and/or alarm bell. The transmitted signals are received by an equipped vehicle within range of the transmitter and if decoded, one or more of the related alarm functions within the vehicle are activated. Preferable alarm functions are an audio alarm for each function signal received, as well as optional light (LED) and voice messaging.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
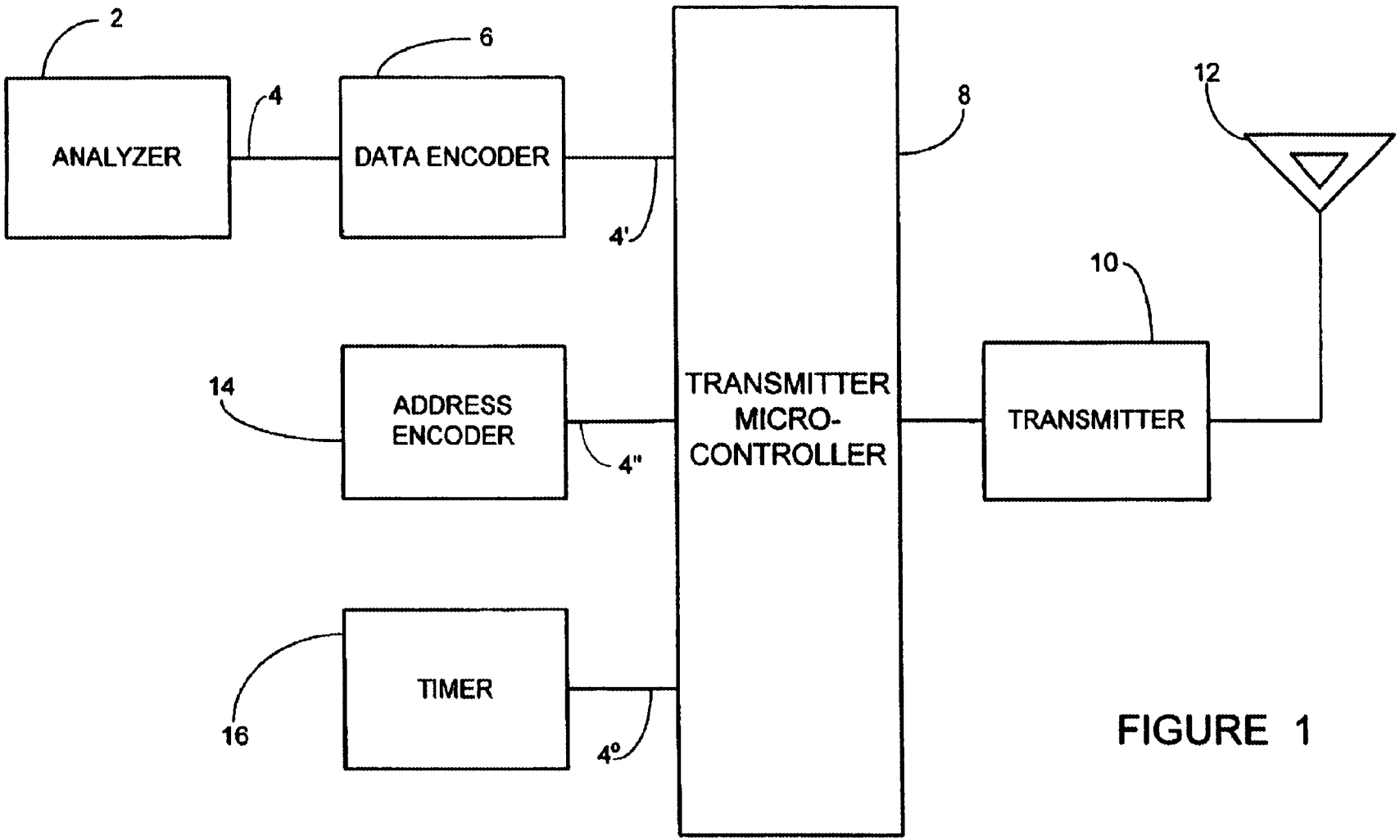
FIG. 1 is a block diagram of the crossing analyzer transmitter for providing the operational signal to the Railroad Advance Warning System of the preferred embodiment of the apparatus of the present invention.

The present invention is illustrated in the accompanying Figures and in its preferred embodiment provides improved means for the prevention of accidents between vehicles (such as automobiles, trucks and busses—particularly school buses) and trains at railway grade crossings. The maintenance of a concerted lookout by a vehicle driver has become increasingly more difficult in recent years with the advent of improved sound insulation of the interior of such as automobiles, and the addition of such internal acoustical/video accessories as high fidelity sound systems, cellular telephones and video players and games for passengers, and particularly children. The central processor of the present invention may be installed into an automobile (or other road traveling vehicle) in a convenient location such as under the dashboard, in the trunk or similar unoccupied, out of the way space, either as automobile manufacturer or after market equipment. The central processor operates in conjunction with the data recorder and reporter incorporated with existing railroad crossing equipment, known as a Smart Events Recorder or Crossing Analyzer. Such units are supplied by existing manufacturers such as the Harmon Division of General Electric Company. Such Crossing Analyzers continually monitor information coming into the Analyzer such as the operable condition of the crossing gate or warning including such as the lights, audio alarm and gate functionality, the proximity (location), approach of a train, and train speed, all of which is utilized by the operating railroad in the management of its railroad system. For operation with the present invention the Crossing Analyzer is modified with a transmitter as is customarily available from a manufacturer, and in the described embodiment, operating at a frequency of 418 Hz as it receives an input of the various event information already generated, stored and/or transmitted to the operating railroad's control station. The crossing transmitter in the present invention is first energized by the approach of a train, as signaled by the Crossing Analyzer which has received and recorded information generated by the sensor system incorporated into a grade crossing warning system (e.g. U.S. Pat. Nos. 5,924,652; 5,170,970; 4,934,633; 4,868,538 and 4,581,700 and such as the Smart Event Recorder by Devtronics, Inc., Atlantic Beach, Florida or one of several models available under the tradenames HCP (Harmon Crossing Processor) and AFTAC (Audio Frequency Train Activated Circuit) from the GE Harris Harmon Railway Technology company. To ensure error-free operation of the present invention, the transmitter, being activated by the Crossing Analyzer's signal of the approach of a train, first sends out a signal with an address code specific to the present automobile system to ensure a "handshake" between the transmitter and the alarm control in the vehicle. Once the address is received, it is verified against the preset code and if verified, the vehicle system activates. Should the address not verify, the vehicle system returns to standby.

In operation, the selected grade crossing and train approach information generated by the Crossing Analyzer is presented to the vehicle system, including processor for the plurality of functions of the onboard alarm. Among the alarms communicated to the operator of the vehicle, are those related to the proper operation of the crossing gate, including warning lights, audio alarm (e.g., bell) and gate articulation as well as information signaling the approach of the train. Accordingly, if for some reason the gate is not fully operational, the system will provide selected information such that the operator of the vehicle is alerted to the fact that the system function is limited so the operator is informed to not totally rely on the warning light, bell or gate function. The operative state of the gate may be signaled in gross (i.e., individual operative state of all lights, audio alarm and gate) or of individual functions, depending upon the degree of detail desired within the system. It should be appreciated by those skilled in the art that the inclusion of the individual alarms adds to the number of individual signals, circuits and indicators, and thus the space and cost requirements of the system. In the minimum configuration, it is preferred that one visual signal (e.g., a dashboard light or icon) be provided for any single crossing gate function (i.e., light, gate articulation) inoperativeness and a separate signal for the approach of a train. Additionally, the vehicle system preferably provides a voice message alerting the vehicle operator to either or both of the approach of the train and a gate component malfunction the voice message reporting such as "crossing gate inoperative" or "train approaching", as appropriate.

Referring now to FIG. 1, the Crossing Analyzer or Smart Events Recorder of a railroad crossing gate is illustrated at 2. Such Crossing Analyzers are customarily required by state agencies, or normally utilized by specific railroads to maintain therein and/or report to a central railroad control station the progress of trains passing a particular crossing and the condition of the operative components of the grade crossing warning system. As indicated above, specific information acquired by Crossing Analyzer 2 selected for the warning information to ultimately be broadcast by the railroad advance warning system (RAWS) according to the present invention is input via line 4 to data encoder 6 which generates a stream of data for each of the parameters generated and recorded in Crossing Analyzer 2 which is selected for a broadcast alarm, such as proximity of a train on the track, malfunction error in a component of the crossing gate (not shown). The transmitter microcontroller 8 receives the encoded data information for ultimate transmission by transmitter 10 via antenna 12. When specific information is received by data encoder 6, it signals address encoder 14 which generates a specific address code to be sent by transmitter 10 to RAWS 20 to signal the system into active mode and verify the authenticity of the succeeding signals to be received. Timer 16 is also activated by data encoder 6 to provide transmitter with information to remain on line for a predetermined period of time (which in the illustrated embodiments is for 20 seconds, however shorter or longer periods may be chosen) subsequent to the last input of Crossing Analyzer information to keep RAWS on line. This feature precludes premature shut-down of the RAWS system in event of intermittent signals from Crossing Analyzer 2. If desired, an indicator such as a LED may provide information that the transmitter 10 is on line. Conveniently, the components of FIG. 1 (excepting antenna 12) may be incorporated into a "black box" for inclusion into the housing for Crossing Analyzer, already mounted in the apparatus section of the crossing gate. Antenna 12 is conveniently mounted on a crossing gate standard or independently, if none is convenient or available. While the components of the transmitter section may be powered by the power supply of the Crossing Analyzer, it may also be preferable for the transmitter to be powered by its own solar cell system such that in the event of a total loss of power to the crossing gate, the inoperative status of the gate may still be signaled to an approaching vehicle with a RAWS system.

Figure 2:
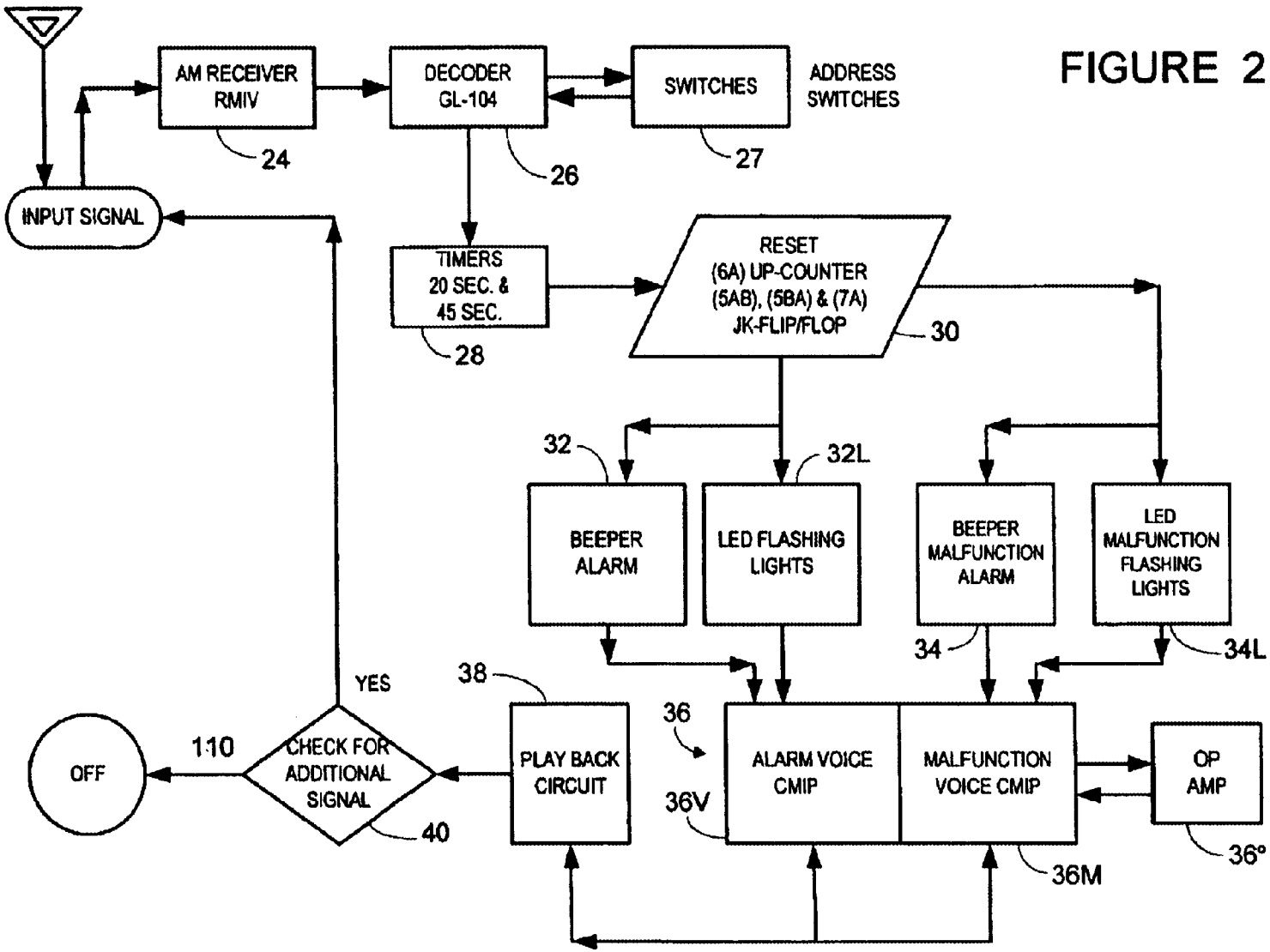
FIG. 2 is a block diagram of the crossing analyzer receiver for providing the alarm from the operational signal of the transmitter illustrated in FIG. 1 in the Railroad Advance Warning System of the preferred embodiment of the apparatus of the present invention.

Referring now to FIG. 2, a signal of an approaching train transmitted by antenna 12 of FIG. 1 is received in RAWS antenna 22 and input to the receiver 24, the output of which is sent to decoder 26 wherein the address code on the incoming signal is checked with that internally set up in the system. If the address code is verified, the output of the decoder 26 is supplied to timer 28 which provide updates at two intervals, such as 20 and 45 seconds in the preferred embodiment described. The input signal is continually supplied by timer 28 to reset 30 to supply the incoming information to the selected alarm outputs. In the illustrated embodiment, the alarms provide a beeper alarm 32 for an approaching train, and an accompanying visual alarm such as by LED; a malfunction alarm 34 in the event of a crossing gate having an inoperable component, together with a visual LED alarm; and a voice alarm 36 which provides a voice output 36V for the approaching train alarm and 36M for the malfunction alarm. If necessary, an additional operational amplifier 360 may amplify the voice messages. Reset 30 interrupts the beeper alarms with the voice alarm according to the timing set by timer 28. Playback circuit 38 and signal check 40 provide for continued activation of the alarms so long as additional input signal is being received at antenna 22.

Figure 3:
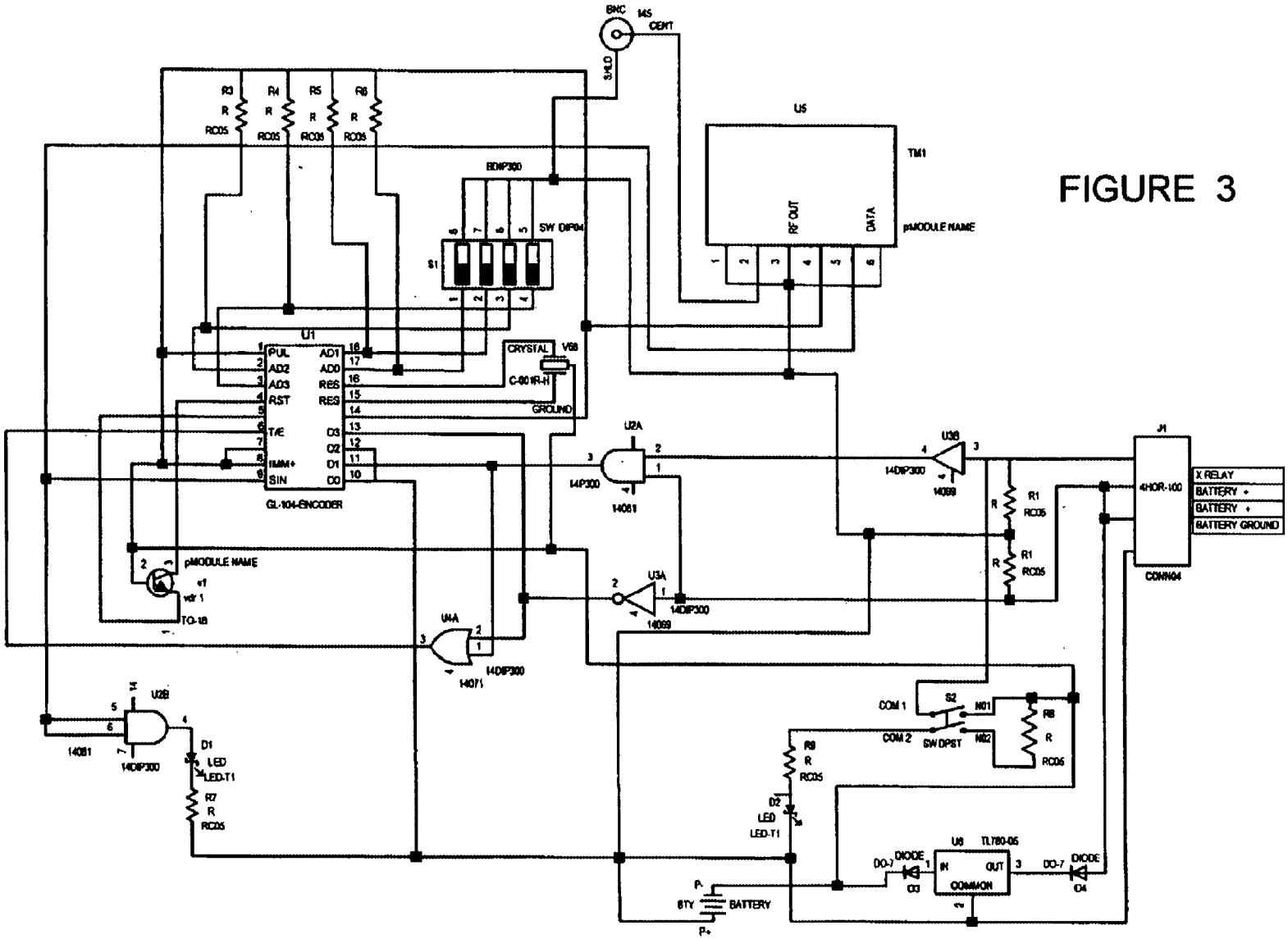
FIG. 3 is a wiring diagram of a preferred embodiment of the apparatus of the block diagram illustrated in FIG. 1.

FIG. 3 illustrates a wiring diagram for the preferred embodiment of the Crossing Analyzer components making up the transmitter section wherein signals from the crossing analyzer identifying train movement and position of the train within the "island", an area adjacent a railroad grade crossing over which the grade crossing warning system exercises a domain for recording and transmitting relevant information via the crossing analyzer. The wiring diagram illustrated incorporated state of the art components known and understood by those skilled in the art, which are assembled and connected to emulate the function illustrated in FIG. 1. While a variety of alternative components might be selected by one skilled in the art, the circuit diagram of FIG. 3 illustrates a convenient and effective assembly to perform the alarm function of the present invention. In FIG. 3 the following components have the indicated values:

| | | |
|---|---|---|
| C10 | 1 μF. | TAJ-A |
| U25 | TM1 | |
| R1, R2, R3, R4<br>R5, R6, R7, R8 | 100 K Ω | RC05 |
| R16, R17 | 1 Meg. Ω | RC05 |
| U5, U5B | 14071 | 14DIP300 |
| U6A | 14081 | 14DIP300 |
| U10 | LM555 | pLM555 |
| J1 | CONN03 | 4HDR-100 |
| Ant1 | Antenna | |
| S1, S2 | SW_DIP04 | |
| U83 | GL-104 | pModule Name |

Figure 4:
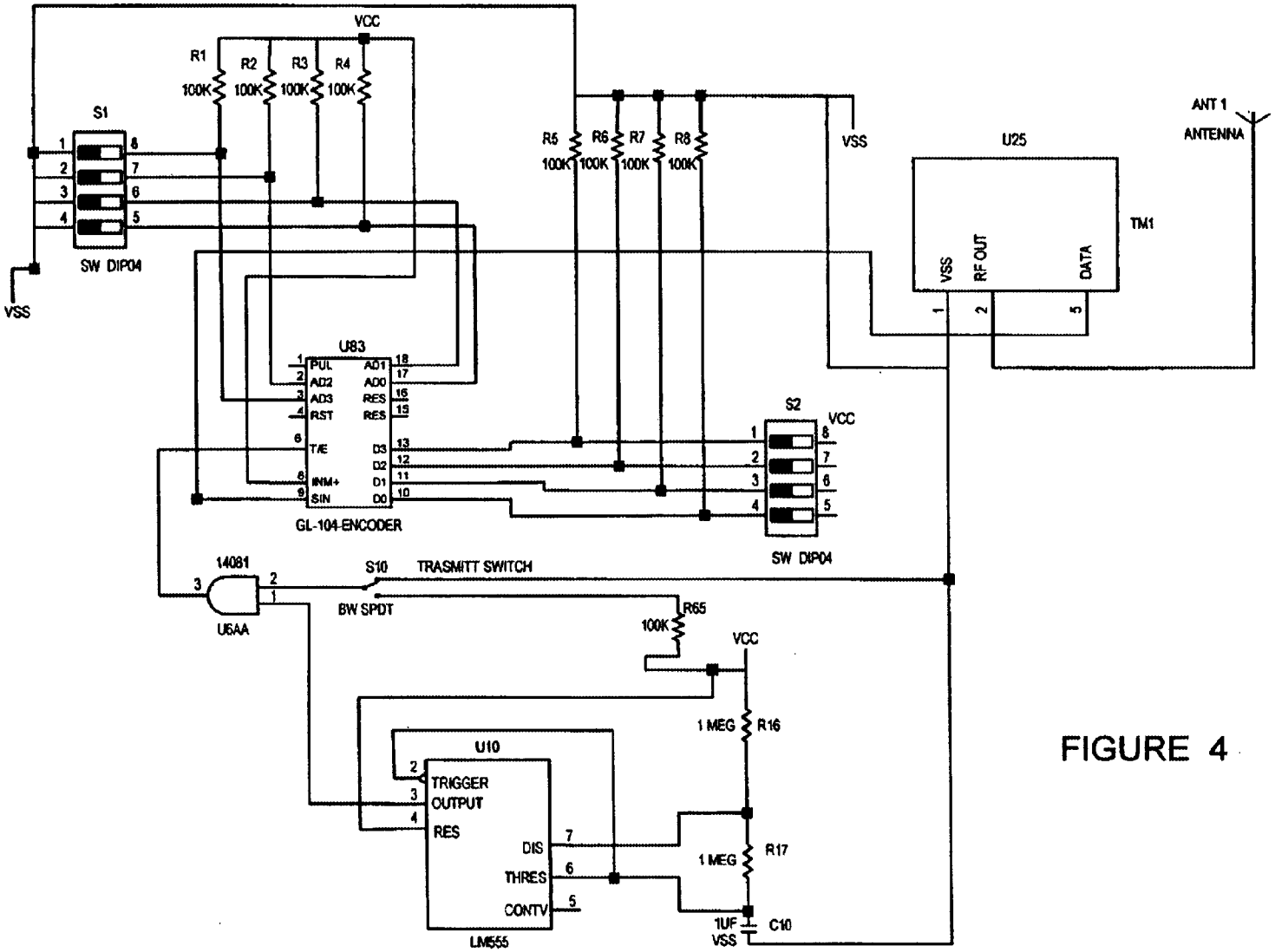
FIG. 4 is a wiring diagram of a preferred embodiment of the apparatus of the block diagram illustrated in FIG. 1 adapted for advance warning of emergency vehicle approach

FIG. 4 illustrates a similar transmitter circuit for the present invention, modified to provide warnings to vehicles coming into close proximity of emergency vehicles, such as fire engines and related fire fighting apparatus and emergency medical vehicles such as ambulances and trucks or vans for emergency medical technicians. The illustrated circuit of FIG. 4 includes state of the art components known and understood by those skilled in the art which are assembled to perform the alarm of the present invention. Those skilled in the art may select alternative combinations of specific components to receive, sense, record and respond in a manner analogous or equivalent to the illustrated embodiment, without departing from the scope of the invention as otherwise illustrated and described. In FIG. 4 the following components have the indicated values:

| | | |
|---|---|---|
| C10 | 1 μF. | TAJ-A |
| U25 | TM1 | |
| R1, R2, R3, R4 | 100 K Ω | RC05 |
| R5, R6, R7, R8 | | |
| R65 | | |
| R16, R17 | 1 Meg. Ω | RC05 |
| U6A | 14081 | 14DIP300 |
| U10 | LM555 | pLM555 |
| Ant1 | Antenna | |
| S1, S2 | SW_DIP04 | |
| U83 | GL-104 Encoder | |

Figure 5:
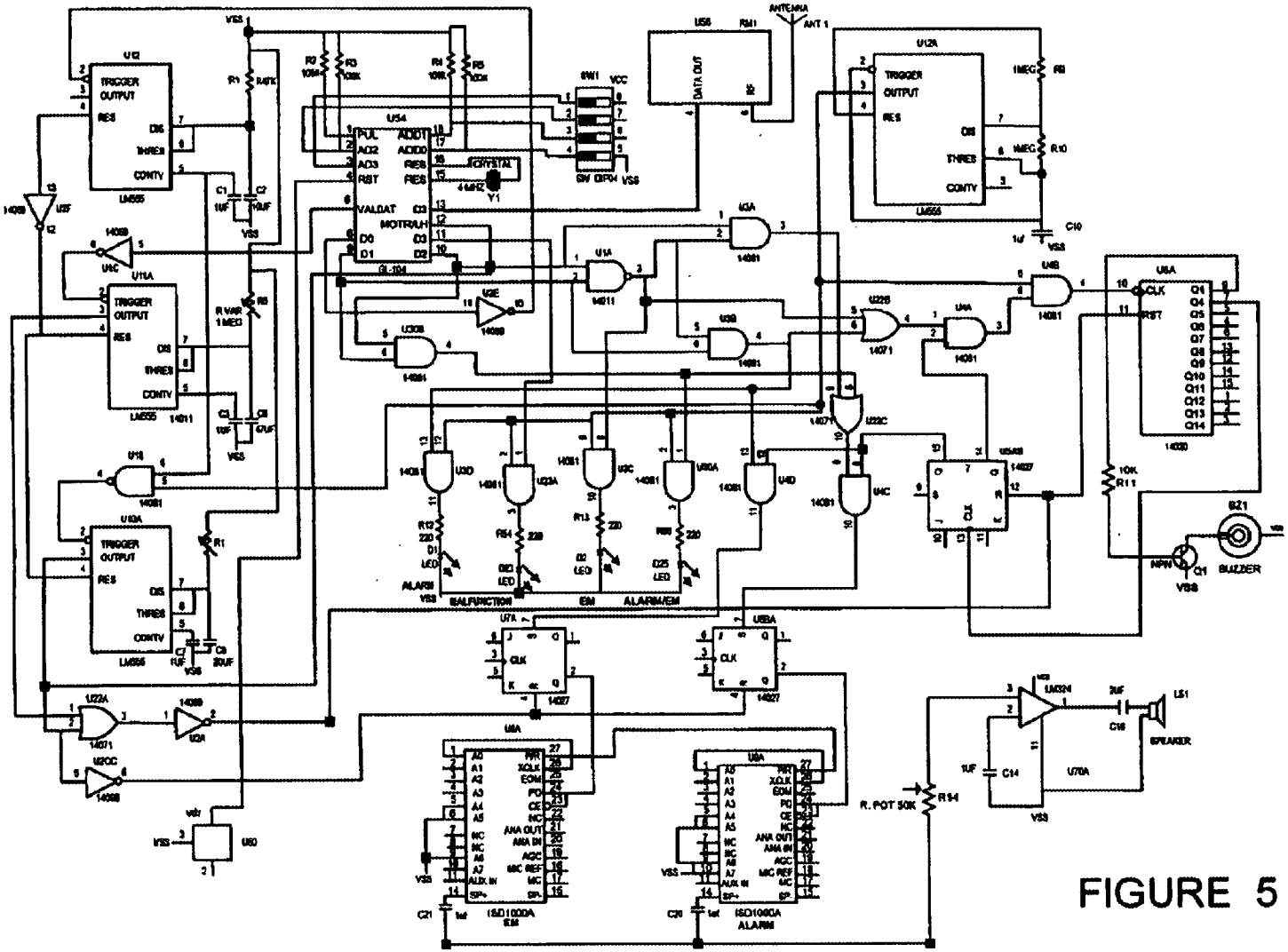
FIG. 5 is a wiring diagram of the receiver apparatus according to the present invention for receiving signals from the transmitter apparatus of FIGS. 1 and 2.

FIG. 5 illustrates a wiring diagram for the preferred embodiment of the RAWS unit receiver and alarm circuit which is adapted for providing warnings for both the events related to railway grade crossings and the approach of emergency vehicles. As with the circuits illustrated in FIGS. 3 and 4, the individual components of FIG. 5 form the operative components illustrated in FIGS. 1 and 2, to the extent that the particular operative modules of those figures are incorporated, the combination and function of which are understood by those skilled in the art. As with the other illustrated embodiments, those skilled in the art may choose different commercially available individual components for combination into the operative modules to perform the illustrated and described invention In FIG. 5 the following components have the indicated values:

| | | |
|---|---|---|
| C10 | 1 μF. | TAJ-A |
| C20 | 1 μF. | TAJ-A |
| C21 | 1 μF. | TAJ-A |
| C10,C20,C21 | 1 μF. | TAJ-A |
| R12,R13,R54,R66 | 220 | RC05 |
| C16 | 2 μF. | TAJ-A |
| D1,D2,D23,D25 | LED | LED-T1 |
| Q1 | NPN | YO-92 |
| U56 | RM1 | pModule Name |
| U60 | vdr | |
| C3,C7,C14 | .1 μF | TAJ-A |
| C1 | .1 μF | TAJ-A |
| R2,R3,R4,R5,R11 | 100K | RC05 |
| C2 | 10 μF | TAJ-A |
| R9,R10 | 1 meg | RC05 |
| C8 | 20 μF | TAJ-A |
| C6 | 47 μF | TAJ-A |
| R1 | R47K | RC05 |
| U1 | 14011 | 14DIP300 |
| U6A | 14020 | 16DIP300 |
| U7,U5A,U5B | 14027 | 16DIP300 |
| U1,U2,U2C | 14069 | 14DIP300 |
| U22 | 14071 | 14DIP300 |
| U3,U4,U23,U30 | 14081 | 14DIP300 |
| U70 | LM324 | 14DIP300 |
| U10A,U11A,U12A | LM555 | pLM555 |
| BZ1 | BUZZER | |
| U54 | GL-104 | |
| ANT 1 | ANTENNA | |
| LS1 | SPEAKER | |
| U8A,U9A | ISD1000A | pISD1000A |

-continued

| | | |
|---|---|---|
| SW1 | SW_DIP04 | 8D1P300 |
| R14 | R_POT 50k | 3059Y |
| R6,R8 | R_VAR 1 MEG | |
| Y1 | CRYSTAL 4 MHZ | C-001R-H |

Those skilled in the art will recognize that the apparatus disclosed in FIG. 5 may be revised to include only those components responsive to the train transmitter of FIG. 3 or to the emergency vehicle transmitter of FIG. 4, thereby simplifying the circuit by merely removing the irrelevant components. By making embodiments exclusively responsive to one or the other of the transmitted alarms will reduce costs of the system by the components eliminated as well as reduce the amount of space accordingly.

The disclosed embodiments are to be considered in all respects as illustrative and not restrictive. The scope of the invention is to be defined by the appended claims rather than the foregoing descriptions and other embodiments which come into the meaning and range of equivalency of the claims are therefore intended to be included within the scope thereof.

What is claimed is:

1. A method of warning a vehicle approaching a railway grade crossing having a grade crossing warning system including a crossing analyzer indicating the operative status of a warning component of the crossing warning system as an approaching train causes the operation of a warning component, comprising the steps of:

supplying selected grade crossing warning component status signals stored in the grade crossing analyzer to a radio frequency transmitter;

transmitting the selected grade crossing warning component status signals to a radio frequency receiver in a vehicle, said receiver including an alarm;

activating said alarm to provide an observable alarm upon said receiver receiving at least one of the selected grade crossing warning component status signals.

2. The method of claim 1 including the transmitter encoding the radio frequency transmission to be selectively received by the receiver and said receiver responding to the received warning component status signals upon recognition of the coding.

3. The method of claim 2 including the selecting one of the grade crossing warning system component status signals responsive to the approach of a train to the railway grade crossing.

4. The method of claim 2 including selecting one of the grade crossing warning system component status signals responsive to the nonoperational function of the grade crossing warning system warning lights.

5. The method of claim 3 including said receiver activating an audio alarm upon receipt of said warning system component status signal.

6. The method of claim 4 including said receiver activating an audio alarm upon receipt of said warning system component status signal.

7. The method of claim 3 including selecting one of the grade crossing warning system component status signals responsive to the nonoperational function of the grade crossing gate warning component.

8. The method of claim 2 including said receiver coming to an active state from a standby state upon the recognition of the crossing analyzer's transmission of a component status signal.

9. The method of claim 7 including said receiver returning to a standby status upon failure to receive a recognized crossing analyzer coded transmission over a predetermined period of time.

10. The method of claim 2 wherein said alarm is an audio alarm.

11. The method of claim 2 wherein said alarm is a visual alarm.

12. The method of claim 10 wherein said alarm is a voice message.

13. Apparatus for warning a vehicle approaching a railway grade crossing having a railroad grade crossing component warning system including a crossing analyzer for accumulating and recording railroad grade crossing component operation events comprising:

a limited range radio frequency transmitter connected to the crossing analyzer through a signal processor, said signal processor being connected to memory containing predetermined recorded component operation events, said transmitter continuously transmitting the status of said predetermined events;

a radio frequency receiver disposed in the vehicle having connected thereto an alarm for at least one of the predetermined recorded component operation status signal events transmitted by the transmitter, said receiver activating said alarm whenever a signal of a component operation event is received.

14. Apparatus according to claim 13 wherein said transmitter includes an encoder for encoding the signal transmitted and said receiver includes a decoder compatible with the encoder for radio frequency signals received from said transmitter, whereby the transmitted crossing component operation status event signals are received by said receiver.

15. Apparatus according to claim 14 wherein said alarm responds to the analyzer recognizing the event of a train approaching the grade crossing by the operation of a component of the crossing warning system.

16. Apparatus according to claim 14 wherein said alarm responds to the event of a malfunction of a warning component in the grade crossing system.

17. Apparatus according to claim 16 wherein the malfunction is at least one of the crossing lights are inoperative.

18. Apparatus according to claim 16 wherein the malfunction is the crossing gate is inoperative.

19. Apparatus according to claim 16 wherein the malfunction is the crossing system power supply has failed.

* * * * *